US012004594B2

(12) United States Patent
Cooper

(10) Patent No.: US 12,004,594 B2
(45) Date of Patent: Jun. 11, 2024

(54) UPPER STRUCTURE OF AN ARTICLE OF FOOTWEAR INCLUDING A CUFF MEMBER

(71) Applicant: NIKE, Inc., Beaverton, OR (US)

(72) Inventor: Aaron A C Cooper, Portland, OR (US)

(73) Assignee: NIKE, INC., Beaverton, OR (US)

( * ) Notice: Subject to any disclaimer, the term of this patent is extended or adjusted under 35 U.S.C. 154(b) by 238 days.

(21) Appl. No.: 17/420,016

(22) PCT Filed: Dec. 27, 2019

(86) PCT No.: PCT/US2019/068674
§ 371 (c)(1),
(2) Date: Jun. 30, 2021

(87) PCT Pub. No.: WO2020/142357
PCT Pub. Date: Jul. 9, 2020

(65) Prior Publication Data

US 2022/0087365 A1 Mar. 24, 2022

Related U.S. Application Data

(60) Provisional application No. 62/786,708, filed on Dec. 31, 2018.

(51) Int. Cl.
*A43B 23/02* (2006.01)
*A43B 1/04* (2022.01)

(52) U.S. Cl.
CPC ..... *A43B 23/027* (2013.01); *A43B 1/04* (2013.01); *A43B 23/024* (2013.01)

(58) Field of Classification Search
CPC . A43B 23/027; A43B 23/024; A43B 23/0235; A43B 23/0275; A43B 23/042;
(Continued)

(56) References Cited

U.S. PATENT DOCUMENTS 3,374,561 A * 3/1968 Werner ..... A43B 5/0462 36/117.6
3,478,738 A * 11/1969 Cox ..... A43B 7/02 36/2.6
(Continued)

FOREIGN PATENT DOCUMENTS

CN 1035043 A 8/1989
CN 102655776 A 9/2012
(Continued)

OTHER PUBLICATIONS

International Search Report and Written Opinion for Application No. PCT/US2019/068674 dated May 7, 2020.
(Continued)

*Primary Examiner* — Bao-Thieu L Nguyen
(74) *Attorney, Agent, or Firm* — Bookoff McAndrews, PLLC.

(57) ABSTRACT

An upper structure of an article of footwear includes an upper, a cuff member, and a strobel. The upper includes an exterior upper member and an interior upper member. The cuff member includes a first end coupled to the exterior upper member and a second end coupled to the interior upper member. The cuff member is folded over on itself at a fold to define an ankle opening. The strobel is coupled to the upper and cooperates with the upper to at least partially define a foot-receiving void.

20 Claims, 5 Drawing Sheets

(58) Field of Classification Search
CPC ..... A43B 23/047; A43B 1/04; A43B 5/02; A43B 7/20
See application file for complete search history.

(56) References Cited

U.S. PATENT DOCUMENTS 4,451,996 A * 6/1984 Norton ..... A43B 19/00 36/129
4,662,088 A * 5/1987 Autry ..... A43B 23/028 36/105
4,852,275 A * 8/1989 Bianchini ..... A43B 5/06 36/11
5,060,402 A * 10/1991 Rosen ..... A43B 3/26 36/97
5,172,493 A * 12/1992 Diaz ..... A41D 17/00 36/1.5
5,174,050 A * 12/1992 Gabrielli ..... A43B 5/0405 36/117.6
5,611,156 A * 3/1997 Chiu ..... A43B 1/0036 36/137
5,765,296 A * 6/1998 Ludemann ..... A43B 23/047 36/97
5,848,484 A * 12/1998 Dupree ..... A43B 3/24 36/114
6,299,962 B1 * 10/2001 Davis ..... B29C 33/306 36/129
2006/0021252 A1 * 2/2006 Throneburg ..... A43B 17/18 36/28
2014/0013621 A1 * 1/2014 Dupree ..... A43B 3/242 36/100
2015/0059209 A1 3/2015 Dekovic et al.
2022/0234336 A1 * 7/2022 Baychar ..... B32B 5/024

FOREIGN PATENT DOCUMENTS

CN 104486959 A 4/2015
CN 106923437 A 7/2017
CN 107874384 A 4/2018
EP 3153052 A1 4/2017
GB 190312787 A 6/1904

OTHER PUBLICATIONS

Extended European Search Report in EP Application 22209159.7, dated Jan. 9, 2023 (8 pages).

* cited by examiner

UPPER STRUCTURE OF AN ARTICLE OF FOOTWEAR INCLUDING A CUFF MEMBER

CROSS REFERENCE TO RELATED APPLICATIONS

The present application is a 371 National Stage entry based on International Application No. PCT/US2019/068674, filed Dec. 27, 2019 which claims priority to U.S. Provisional Patent Application No. 62/786,708, filed Dec. 31, 2018, the disclosures of which are hereby incorporated by reference in their entirety.

FIELD

The present disclosure relates generally to articles of footwear and more particularly to an upper structure for an article of footwear.

BACKGROUND

This section provides background information related to the present disclosure and is not necessarily prior art.

Articles of footwear conventionally include an upper and a sole structure. The upper may be formed from any suitable material(s) to receive, secure, and support a foot on the sole structure. Laces, straps, or other fasteners may cooperate with the upper to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. Another layer of the sole structure includes a midsole disposed between the outsole and the upper. Sole structures may also include a comfort-enhancing insole and/or a sock-liner located within a void proximate to the bottom portion of the upper.

The outsole may be formed from rubber, composite, or other materials that impart durability and wear-resistance, as well as enhance stability and traction with the ground surface. The midsole provides cushioning for the foot and compresses resiliently under an applied load, such as during walking or running movements, to cushion the foot by attenuating ground-reaction forces. The midsole may define a bottom surface on one side that opposes the outsole and a footbed on the opposite side that may be contoured to conform to a profile of the bottom surface of the foot. Generally, midsoles are designed with an emphasis on balancing cushioning characteristics that relate to softness and responsiveness as the midsole compresses under gradient loads.

While traditional upper structures are suitable for securing an article of footwear to a user's foot, improvements to upper structures are continuously being sought in order to advance the arts.

DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
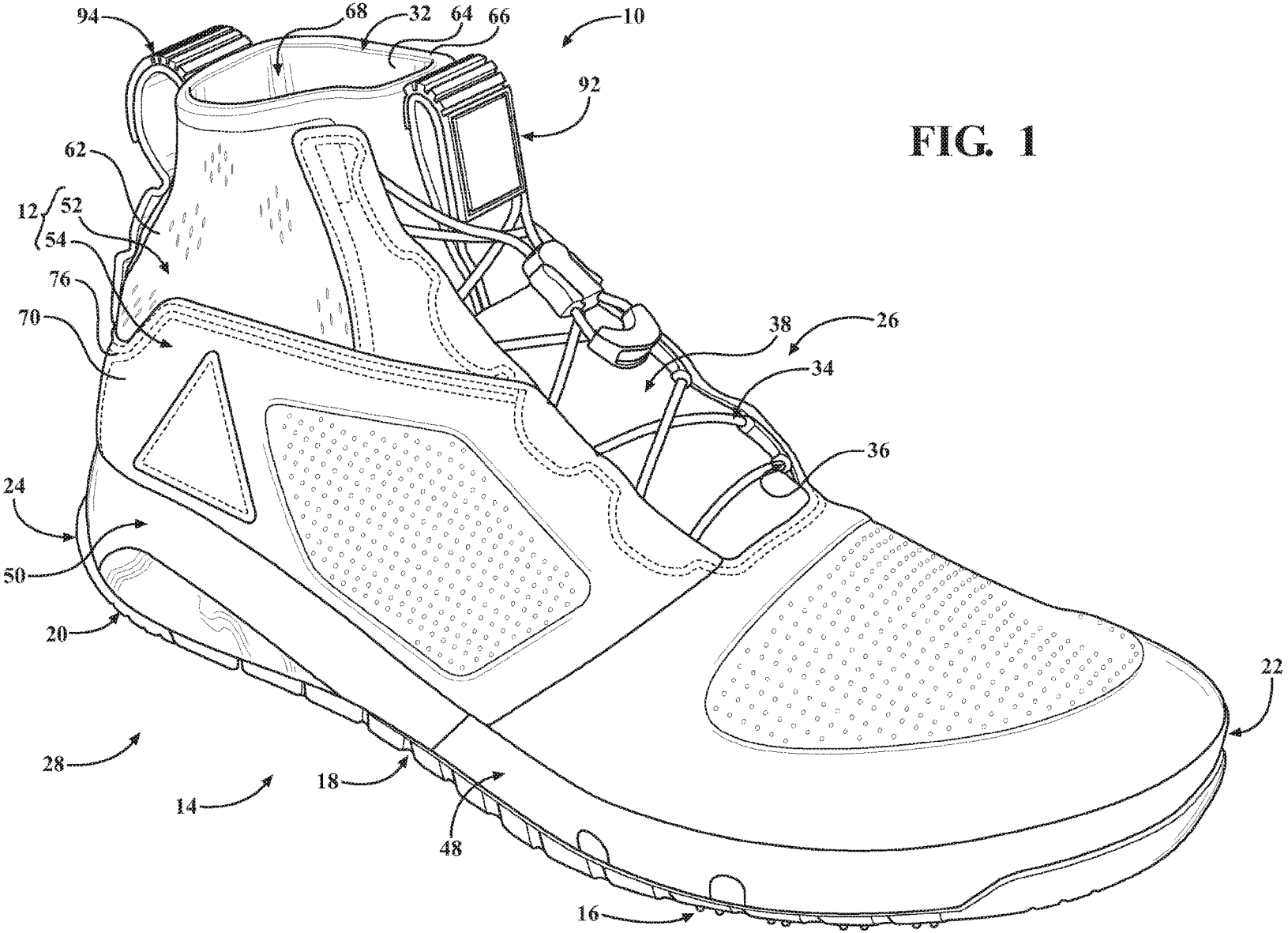
FIG. 1 is a perspective view of an article of footwear incorporating an upper structure in accordance with the principles of the present disclosure.
Figure 2:
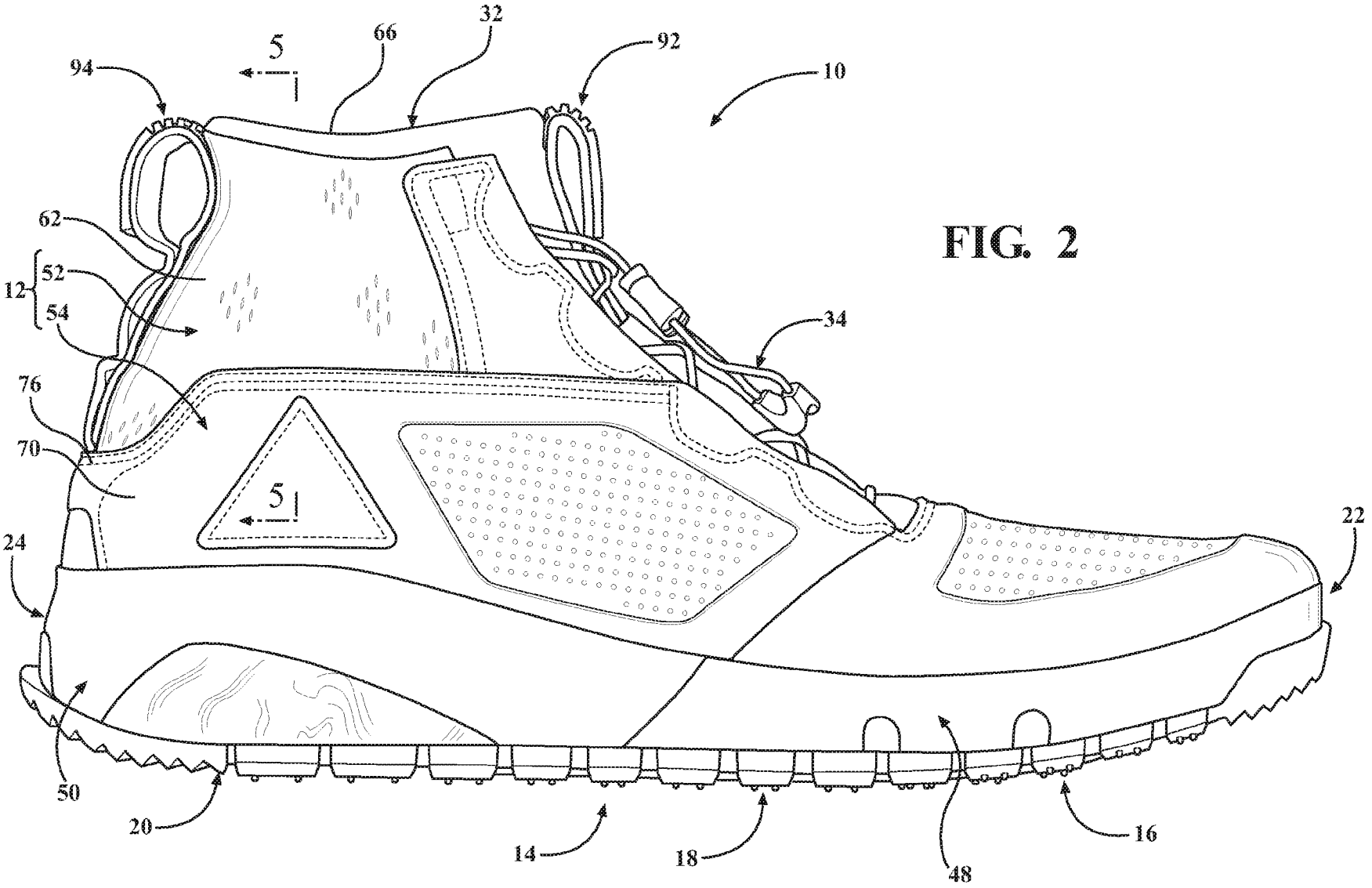
FIG. 2 is a lateral side view of the article of footwear of FIG. 1.

Example embodiments will now be described more fully with reference to the accompanying drawings. Example embodiments are provided so that this disclosure will be thorough, and will fully convey the scope of those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of moded features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms.

These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to the figures, an upper structure for an article of footwear is provided. The upper structure includes an upper, a cuff member, and a strobel. The upper includes an exterior upper member and an interior upper member. The cuff member includes a first end coupled to the exterior upper member and a second end coupled to the interior upper member. The cuff member is folded over on itself at a fold to define an ankle opening. The strobel is coupled to the upper and cooperates with the upper to at least partially define a foot-receiving void.

In some implementations, the cuff member is formed from a knit material.

In some implementations, the interior upper member is formed from an elastic material. The elastic material may be spandex. The exterior upper member may be formed from an inelastic material. The first end of the cuff member may be secured to the exterior upper member by a first fastener and the second end of the cuff member may be secured to the interior upper member by a second fastener. The upper may also include an intermediate upper member disposed between the exterior upper member and the interior upper member. The intermediate upper member may extend between opposing portions of the cuff member and may be arranged between the first end of the cuff member and the second end of the cuff member. The first fastener may extend through the exterior upper member and the second fastener may extend through the interior upper member.

In some implementations, the strobel is secured to the upper by a third fastener extending through the strobel and at least the interior upper member. The third fastener may extend through the exterior upper member. The upper may also include an intermediate upper member extending between the exterior upper member and the interior upper member. The third fastener may extend through the intermediate upper member.

In some implementations, the cuff member includes an exterior cuff portion, an interior cuff portion, and an intermediate cuff portion connecting the exterior cuff portion to the interior cuff portion. The exterior cuff portion may include the first end of the cuff member and the interior cuff portion may include the second end of the cuff member. In some implementations, the interior cuff portion opposes the exterior cuff portion. In some implementations, the upper structure includes a heel counter secured to the interior upper member and the interior cuff portion. In some implementations, the heel counter at least partially extends over and is secured to the interior cuff portion of the cuff member.

In some implementations, the upper structure includes an anterior pull tab secured to an anterior region of the exterior cuff portion. The anterior region of the exterior cuff portion may include a tongue region of the exterior cuff portion and may be located between a medial region of the exterior cuff portion and a lateral region of the exterior cuff portion. The anterior pull tab may be arranged on the exterior cuff portion proximate the intermediate cuff portion.

In some implementations, the upper structure includes a posterior pull tab secured to a posterior region of the exterior cuff portion. The posterior region of the exterior cuff portion may at least partially include a heel region of the exterior cuff portion and may be located between a medial region of the exterior cuff portion and a lateral region of the exterior cuff portion. The posterior pull tab may be arranged on the exterior cuff portion proximate the intermediate cuff portion.

According to another aspect of the present disclosure, an upper structure of an article of footwear is provided. The upper structure includes an upper and a cuff member. The upper at least partially defines a foot-receiving void and is formed at least in part from an inelastic material. The cuff member is formed at least in part from a first elastic material and includes a first end coupled to the upper, a second end coupled to the upper, and a fold disposed between the first end and the second end. The fold is offset from the upper and at least partially defines an ankle opening in communication with the foot-receiving void. The cuff member includes an inner surface defining a cuff void extending between the first end, the second end, and the fold. The cuff void may extend between the upper and the fold. The first end may define a first opening having a first diameter. The second end may define a second opening having a second diameter. The fold may be configured to define a third opening having a third diameter that is greater than the first diameter and the second diameter.

In some implementations, the upper structure includes a strobel coupled to the upper. The strobel and the upper may at least partially define the foot-receiving void.

In some implementations, the first elastic material includes a knit material.

In some implementations, the upper includes an exterior upper member formed from the inelastic material and an interior upper member formed from a second elastic material. The second elastic material may be spandex. The first end of the cuff member may be secured to the exterior upper member by a first fastener and the second end of the cuff member may be secured to the interior upper member by a second fastener. The upper may include an intermediate upper member disposed between the exterior upper member and the interior upper member. The intermediate upper member may be arranged between the first end of the cuff member and the second end of the cuff member.

In some implementations, the first fastener extends through the exterior upper member and the second fastener extends through the interior upper member.

In some implementations, the upper structure includes a strobel coupled to the upper by a third fastener extending through the strobel and at least the interior upper member. The strobel and the upper may at least partially define the foot-receiving void. The third fastener may extend through the exterior upper member. The upper may further include an intermediate upper member extending between the exterior upper member and the interior upper member. The third fastener may extend through the intermediate upper member.

In some implementations, the cuff member includes an exterior cuff portion, an interior cuff portion, and an intermediate cuff portion connecting the exterior cuff portion to the interior cuff portion. The exterior cuff portion may include the first end of the cuff member and the interior cuff portion may include the second end of the cuff member. In some implementations, the interior cuff portion at least partially forms an ankle-receiving void disposed between the ankle opening and the foot-receiving void. In some implementations, the upper structure includes a heel counter secured to upper and the interior cuff portion. The heel counter may at least partially define the foot-receiving void. The heel counter may at least partially extend over and be secured to the interior cuff portion.

In some implementations, the upper structure includes an anterior pull tab secured to an anterior region of the exterior cuff portion. The anterior region of the exterior cuff portion may include a tongue region of the exterior cuff portion and may be located between a medial region of the exterior cuff portion and a lateral region of the exterior cuff portion. In some implementations, the anterior pull tab is arranged on the exterior cuff portion proximate the intermediate cuff portion.

In some implementations, the upper structure includes a posterior pull tab secured to a posterior region of the exterior cuff portion. The posterior region of the exterior cuff portion may at least partially include a heel region of the exterior cuff portion and may be located between a medial region of the exterior cuff portion and a lateral region of the exterior cuff portion. The posterior pull tab may be arranged on the exterior cuff portion proximate the intermediate cuff portion.

With reference to FIGS. 1-5, an article of footwear 10 is provided and includes an upper structure 12 and a sole structure 14 attached to the upper structure 12. The article of footwear 10 may be divided into one or more regions. As seen in FIG. 1, the regions may include a forefoot region 16, a midfoot region 18, and a heel region 20. The forefoot region 16 may correspond with toes and joints connecting metatarsal bones with phalanx bones of a foot, and may include an anterior end 22 of the article of footwear 10. The midfoot region 18 may correspond with an arch area of the foot while the heel region 20 may correspond with rear portions of the foot, including a calcaneus bone, and may include a posterior end 24 of the article of footwear 10. The article of footwear 10 may additionally include a medial side 26 and a lateral side 28 that correspond with opposite sides of the article of footwear 10 and extend through the regions 16, 18, 20.

The upper structure 12 includes interior surfaces that define an interior foot-receiving void 30 (see FIGS. 4-5) that is sized for receiving and securing a foot for support on the sole structure 14. An ankle opening 32 in the heel region 20 may provide access to the interior foot-receiving void 30. For example, the ankle opening 32 may receive a foot to secure the foot within the void 30 and facilitate entry and removal of the foot from and to the interior foot-receiving void 30.

In some examples, one or more fasteners 34 extend along the upper structure 12 to adjust a fit of the upper structure 12 around the foot while concurrently accommodating entry and removal of the foot therefrom. The upper structure 12 may include apertures 36 such as eyelets and/or other engagement features such as fabric or mesh loops that receive the fasteners 34. The fasteners 34 may include laces, straps, cords, hook-and-loop, or any other suitable type of fastener. The upper structure 12 may additionally include a tongue portion 38 that extends between the interior foot-receiving void 30 and the fasteners 34.

Optionally, the upper structure 12 may include a strobel 40 (see FIGS. 3-5 and 7) configured to enclose a bottom portion of the interior foot-receiving void 30. The strobel 40 may be joined to the upper structure 12 using stitching. In some examples, the strobel 40 may additionally or alternatively be adhesively bonded to the upper structure 12, and may include multiple layers of material.

As illustrated in FIGS. 3-7, the upper structure 12 may include one or more materials, such as a plurality of sheets or layers of material 70, 72, 74, that are stitched or adhesively bonded together to form the interior foot-receiving void 30. Suitable materials of the upper structure 12 may include, textiles, foam, leather, and synthetic leather. The materials may be selected and located to impart properties of durability, air-permeability, wear-resistance, flexibility, and comfort to the foot while disposed within the interior foot-receiving void 30.

The sole structure 14 is attached to the upper structure 12 and provides the article of footwear 10 with support and cushioning during use. For example, the sole structure 14 may attenuate ground-reaction forces caused by the article of footwear 10 striking the ground during use. Accordingly, the sole structure 14 may incorporate one or more materials having energy absorbing characteristics to allow the sole structure 14 to minimize the impact experienced by a user when wearing the article of footwear 10.

Figure 3:
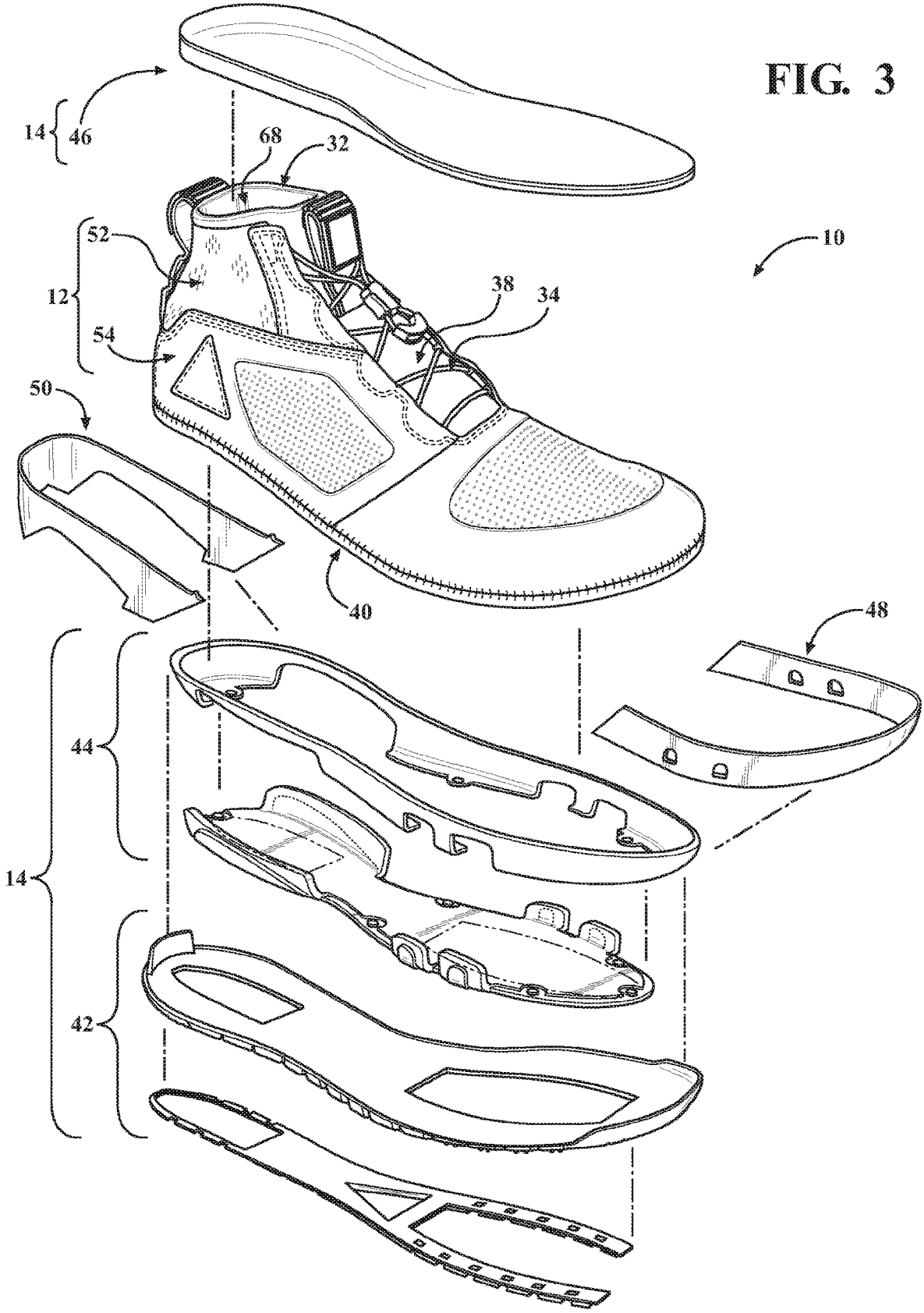
FIG. 3 is an exploded view of the article of footwear of FIG. 1.

Referring to FIG. 3, the sole structure 14 may include different layers, such as, for example, an outsole 42, a midsole 44 and a sockliner or insole 46. Each layer may serve a particular function. For example, the outsole 42 may include a plurality of regions having different hardness characteristics (e.g., sticky rubber for providing higher friction and hard rubber forming cleats) that react differently when engaged with an underlying ground surface. In another example, one or both of the midsole 44 and the insole 46 may be designed to contact the foot to provide enhanced comfort to the foot. In this regard, the insole 46 may be disposed within the interior foot-receiving void 30. In an example as seen in FIG. 3, when the upper structure 12 includes the strobel 40, the insole 46 is formed separately from the midsole 44, and is disposed on an opposite side of the strobel 40 from the midsole 44. In other examples, where the upper structure 12 does not include the strobel 40, the insole 46 may include a layer formed into the sole structure 14 such that the insole 46 is disposed adjacent to the midsole 44 in an assembled configuration. A material, or combination of materials, of the insole 46 may be selected to impart properties of cushioning, stability, ventilation, and breathability.

With continued reference to FIG. 3, the midsole 44 may be disposed between the strobel 40 and the outsole 42. As shown, the midsole 44 opposes the strobel 40 and is disposed between the strobel 40 and the outsole 42. However, as discussed above, the strobel 40 may not be included in some configurations, and the midsole 44 may be disposed directly between the insole 46 and the outsole 42. Furthermore, the upper structure 12 may optionally include one or more trim bands 48, 50 such as, for example, forefoot region trim band 48 and a heel region trim band 50 that is disposed over and trims one or more exterior surfaces of the strobel 40, the outsole 42 or the midsole 44.

With reference to FIGS. 1-4, the upper structure 12 includes a cuff member 52 attached to an upper 54. The upper structure 12 may also optionally include the strobel 40.

Figure 4:
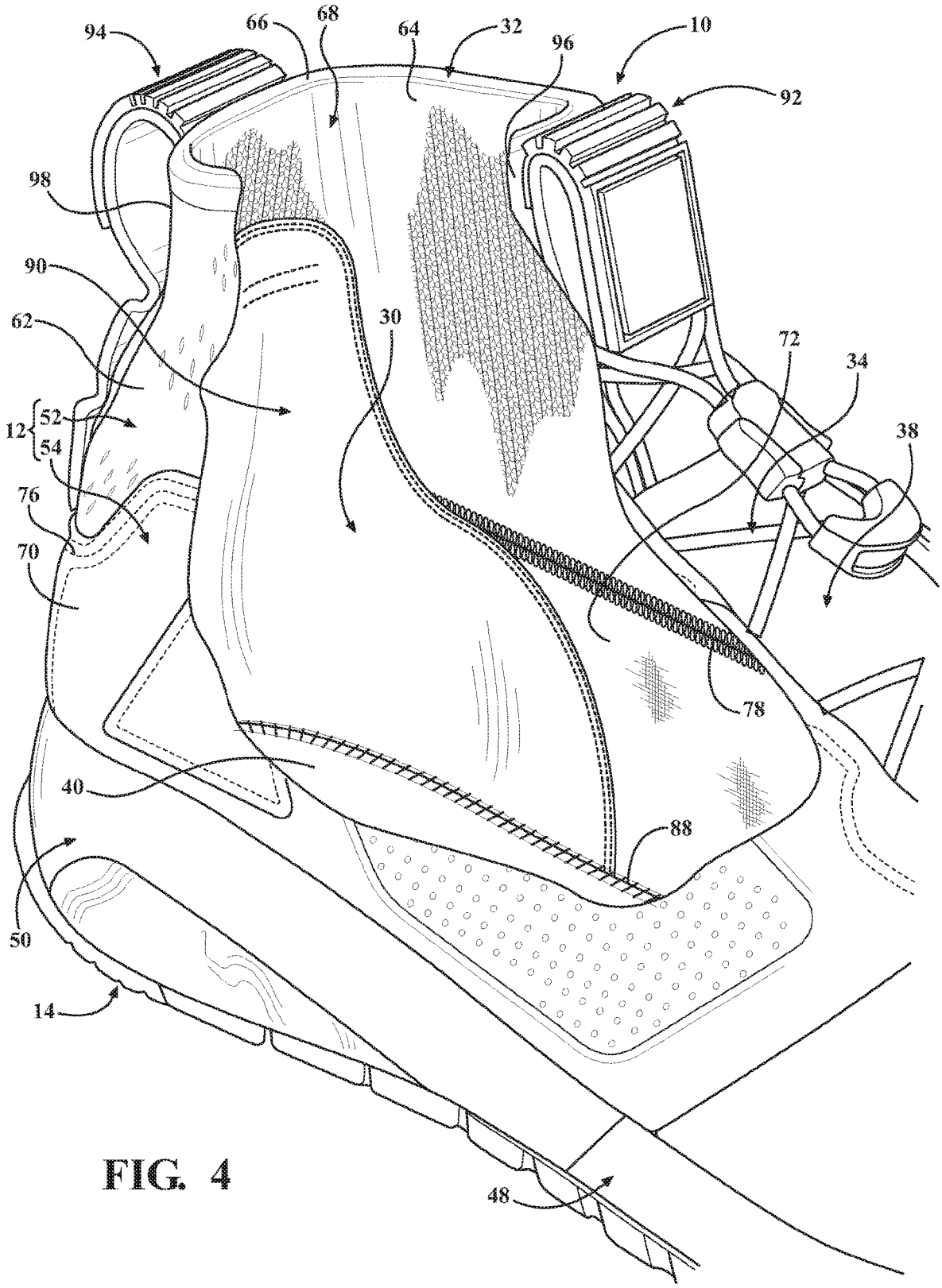
FIG. 4 is a partial perspective view of the article of footwear of FIG. 1 revealing a an interior foot-receiving void and an ankle-receiving void.

The cuff member 52 defines the ankle opening 32. Furthermore, as seen in FIG. 4, the cuff member 52 may also include the tongue portion 38.

Figure 5:
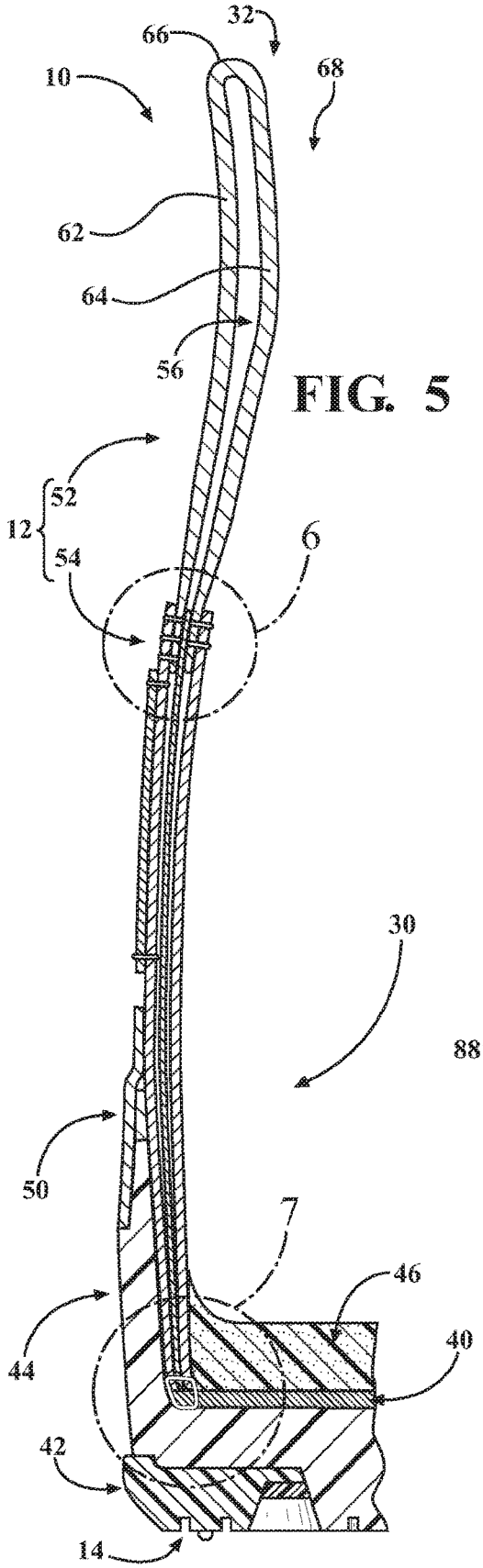
FIG. 5 is a cross-sectional view of the article of footwear of FIG. 1 taken along Line 5-5 of FIG. 2.
Figure 6:
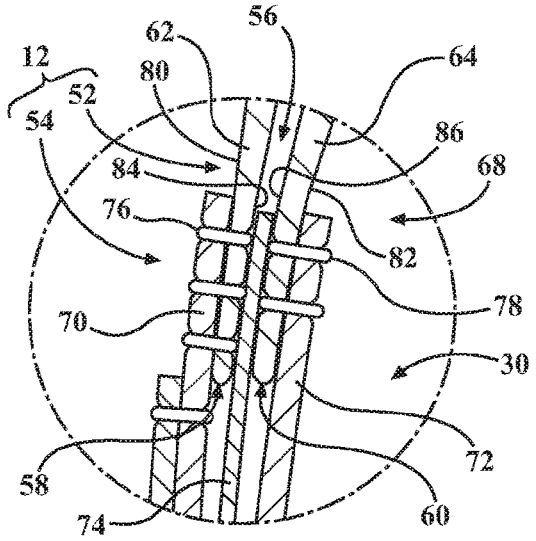
FIG. 6 is an enlarged cross-sectional view of the article of footwear of FIG. 1 taken along Line 6 of FIG. 5.

Referring to FIG. 5, the cuff member 52 may include a sheet or layer of material that is folded upon itself, defining a cuff void 56. With reference to FIG. 6, the sheet or layer of material of the cuff member 52 includes a first end 58 and a second end 60 that are secured to the upper 54.

As seen in FIG. 5, when the cuff member 52 is arranged in the folded configuration, the cuff member 52 includes an exterior cuff portion 62, an interior cuff portion 64 and an intermediate cuff portion 66 connecting the exterior cuff portion 62 to the interior cuff portion 64. The interior cuff portion 64 defines an ankle-receiving void 68 that is sized for receiving and conforming to a user's ankle. The intermediate cuff portion 66 defines the ankle opening 32. The exterior cuff portion 62 faces a surrounding environment.

With reference to FIG. 6, the exterior cuff portion 62 includes the first end 58 of the sheet or layer of material of the cuff member 52. The interior cuff portion 64 includes the second end 60 of the sheet or layer of material of the cuff member 52.

The sheet or layer of material of the cuff member 52 may be a conformable material. The conformable material permits the cuff member 52 to conform to a user's ankle in order to mitigate intrusion of debris (e.g., dirt, mud, stones, pebbles, rocks, twigs and the like) into one or more of the interior foot-receiving void 30 that receives and secures the user's foot and the ankle-receiving void 68 that is sized for receiving the user's ankle. In some implementations, the conformable material of the cuff member 52 includes an elastic material. Furthermore, the conformable material may be a knit material. The conformable knit material allows heat and moisture to pass from one or more of the interior foot-receiving void 30 and the ankle-receiving void 68 to the surrounding environment in order to increase comfort when the user's foot and ankle are respectively disposed within the interior foot-receiving void 30 and the ankle-receiving void 68.

Figure 7:
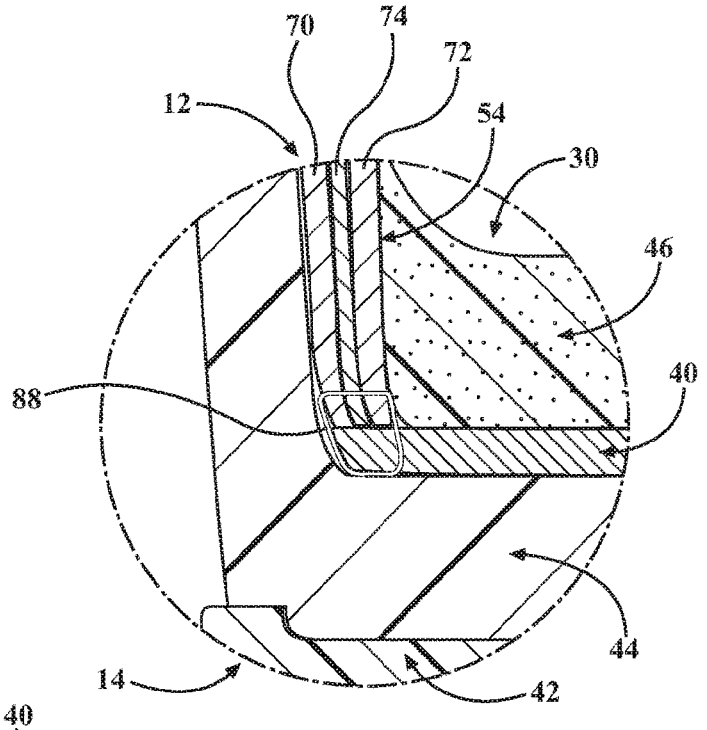
FIG. 7 is an enlarged cross-sectional view of the article of footwear of FIG. 1 taken along Line 7 of FIG. 5.

Referring to FIGS. 6-7, the upper 54 includes the plurality of sheets or layers of material 70-74. The plurality of sheets or layers of material 70-74 of the upper 54 includes an exterior upper member 70 and an interior upper member 72. In some configurations, the plurality of sheets or layers of material 70-74 of the upper 54 may optionally include an intermediate upper member 74 arranged between the exterior upper member 70 and the interior upper member 72. The exterior upper member 70 faces surrounding environment. The interior upper member 72 at least partially defines the interior foot-receiving void 30.

The plurality of sheets or layers of material 70-74 of the upper 54 may include elastic or inelastic materials. In an example, the interior upper member 72 of the plurality of sheets or layers of material 70-74 may include an elastic material and the exterior upper member 70 of the plurality of sheets or layers of material 70-74 may include an inelastic material. The elastic material defining the interior upper member 72 may be spandex. The exterior upper member 70 may include, but is not limited to textiles, foam, leather, and synthetic leather. Similarly, the intermediate upper member 74 may include, but is not limited to textiles, foam, leather, and synthetic leather.

With continued reference to FIG. 6, in an example, the exterior upper member 70 is secured to the exterior cuff portion 62 by a first fastener 76 and the interior upper member 72 is secured to the interior cuff portion 64 by a second fastener 78. Furthermore, as seen in FIG. 6, the first fastener 76 may extend through both of the exterior upper member 70 and the exterior cuff portion 62 while not extending through the intermediate upper member 74, the interior cuff portion 64 or the interior upper member 72. Yet even further, the second fastener 78 may extend through both of the interior upper member 72 and the interior cuff portion 64 while not extending through the intermediate upper member 74, the exterior cuff portion 62 or the exterior upper member 70.

In an example, each of the first fastener 76 and the second fastener 78 is a thread resulting in a sewn or stitched connection of a layer or sheet of material of the exterior cuff portion 62 to the layer or sheet of material of the exterior upper member 70 and of a layer or sheet of material of the interior cuff portion 64 to the layer or sheet of material of the interior upper member 72, as described above. Although the first fastener 76 and the second fastener 78 may include a thread resulting in a sewn or stitched connection, the first fastener 76 or the second fastener 78 may alternatively or additionally include other fastener materials such as, for example, adhesive for connecting the layers or sheets of material of the exterior cuff portion 62 and exterior upper member 70 and the layer or sheets of material of the interior cuff portion 64 and the intermediate upper member 72, as described above.

In some configurations, the exterior upper member 70 is secured to and disposed adjacent an exterior surface 80 of the exterior cuff portion 62, and the interior upper member 72 is secured to and disposed adjacent an exterior surface 82 of the interior cuff portion 64. The exterior surface 80, 82 of each of the exterior cuff portion 62 and the interior cuff portion 64 do not define the cuff void 56 (i.e., an interior surface 84, 86 of each of the exterior cuff portion 62 and the interior cuff portion 64 defines the cuff void 56).

In another example, the intermediate upper member 74 extends into the cuff void 56 such that the intermediate upper member 74 is disposed adjacent or opposite the interior surface 84, 86 of each of the exterior cuff portion 62 and the interior cuff portion 64. Accordingly, the intermediate upper member 74 is disposed between the exterior cuff portion 62 and the interior cuff portion 64.

Referring to FIG. 7, the upper 54 may be secured to the strobel 40. In a first example, the upper 54 is secured to the strobel 40 by a third fastener 88. In the first example, the third fastener 88 extends through the strobel 40 and at least the interior upper member 72 that may include an elastic material (e.g. spandex). In another example, the third fastener 88 extends through the strobel 40 and at least the exterior upper member 70 that may include an inelastic material. In some configurations, the third fastener 88 extends through the strobel 40, the exterior upper member 70 that may include an inelastic material and the interior upper member 72 that may include an elastic material (e.g., spandex). In yet another example, the third fastener 88 extends through the strobel 40, the exterior upper member 70 that may include an inelastic material, the interior upper member 72 that may include an elastic material (e.g., spandex) and the intermediate upper member 74.

As seen in FIG. 4, in another configuration, the upper structure 12 may optionally include a heel counter 90. The heel counter 90 may be secured to or disposed over a portion of the interior cuff portion 64 of the cuff member 52. The heel counter 90 may also be secured to or disposed over the interior upper member 72 of the upper 54.

Referring to FIGS. 1-4, the upper structure 12 may further include a first pull tab 92 and a second pull tab 94. The first pull tab 92 or the second pull tab 94 may be secured to the cuff member 52. In some configurations, the first or second pull tabs 92, 94 are secured to the exterior cuff portion 62 of the cuff member 52 and are arranged near or proximate the intermediate cuff portion 66 of the cuff member 52 such that the first or second pull tabs 92, 94 are arranged near or proximate the ankle opening 32.

With reference to FIG. 4, in an example, the first pull tab 92 may be an anterior pull tab 92 secured to an anterior region 96 of the exterior cuff portion 62 of the cuff member 52, and the second pull tab 94 may be a posterior pull tab 94 secured to a posterior region 98 of the exterior cuff portion 62 of the cuff member 52. In yet another example, the first or second pull tabs 92, 94 may include both of the anterior pull tab 92 secured to the anterior region 96 of the exterior cuff portion 62 of the cuff member 52 and the posterior pull tab 94 secured to the posterior region 98 of the exterior cuff portion 62 of the cuff member 52.

In an example, the anterior region 96 of the exterior cuff portion 62 includes at least some of the tongue portion 38 of the article of footwear 10. In another example, the anterior region 96 of the exterior cuff portion 62 is located between a medial region of the exterior cuff portion 62 and a lateral region of the exterior cuff portion 62.

In an example, the posterior region 98 of the exterior cuff portion 62 includes at least a portion of a heel region of the article of footwear 10. In another example, the posterior region 98 of the exterior cuff portion 62 is located between the medial region of the exterior cuff portion 62 and the lateral region of the exterior cuff portion 62.

The foregoing article of footwear 10 incorporates an upper structure 12 having a cuff member 52 and upper 54 that provide a degree of comfort and conformability to a user's ankle while mitigating intrusion of debris (e.g., dirt, mud, stones, pebbles, rocks, twigs and the like) into one or more of the interior foot-receiving void 30 that receives and secures the user's foot and the ankle-receiving void 68 that is sized for receiving the user's ankle user during use of the particular article of footwear 10. Furthermore, the foregoing article of footwear 10 incorporates an outsole 42 that includes a plurality of regions having different hardness characteristics (e.g., sticky rubber for providing higher friction and hard rubber forming cleats) that react differently when engaged with an underlying ground surface. Accordingly, the article of footwear 10 may be used for a variety of athletic activities such as hiking, biking, rock climbing, running, basketball, or the like.

The following Clauses provide an exemplary configuration for an upper structure for an article of footwear and an article of footwear described above.

Clause 1. An upper structure of an article of footwear, the upper structure comprising (i) an upper including an exterior upper member and an interior upper member, (ii) a cuff member including a first end coupled to the exterior upper member and a second end coupled to the interior upper member, the cuff member folded over on itself at a fold to define an ankle opening, and (iii) a strobel coupled to the upper and cooperating with the upper to at least partially define a foot-receiving void.

Clause 2. The upper structure of Clause 1, wherein the cuff member is formed from a knit material.

Clause 3. The upper structure of Clause 1, wherein the interior upper member is formed from an elastic material.

Clause 4. The upper structure of Clause 3, wherein the elastic material is spandex.

Clause 5. The upper structure of Clause 3, wherein the exterior upper member is formed from an inelastic material.

Clause 6. The upper structure of Clause 1, wherein the first end of the cuff member is secured to the exterior upper member by a first fastener and the second end of the cuff member is secured to the interior upper member by a second fastener.

Clause 7. The upper structure of Clause 6, wherein the upper further includes an intermediate upper member disposed between the exterior upper member and the interior upper member, the intermediate upper member extending between opposing portions of the cuff member and arranged between the first end of the cuff member and the second end of the cuff member.

Clause 8. The upper structure of Clause 7, wherein the first fastener extends through the exterior upper member and the second fastener extends through the interior upper member.

Clause 9. The upper structure of Clause 6, wherein the strobel is secured to the upper by a third fastener extending through the strobel and at least the interior upper member.

Clause 10. The upper structure of Clause 9, wherein the third fastener extends through the exterior upper member.

Clause 11. The upper structure of Clause 9, wherein the upper further includes an intermediate upper member extending between the exterior upper member and the interior upper member, the third fastener extending through the intermediate upper member.

Clause 12. The upper structure of Clause 1, wherein the cuff member includes an exterior cuff portion, an interior cuff portion, and an intermediate cuff portion connecting the exterior cuff portion to the interior cuff portion, the exterior cuff portion including the first end of the cuff member and the interior cuff portion including the second end of the cuff member.

Clause 13. The upper structure of Clause 12, wherein the interior cuff portion opposes the exterior cuff portion.

Clause 14. The upper structure of Clause 12, further comprising a heel counter secured to the interior upper member and the interior cuff portion.

Clause 15. The upper structure of Clause 14, wherein the heel counter at least partially extends over and is secured to the interior cuff portion of the cuff member.

Clause 16. The upper structure of Clause 12, further comprising an anterior pull tab secured to an anterior region of the exterior cuff portion.

Clause 17. The upper structure of Clause 16, wherein the anterior region of the exterior cuff portion includes a tongue region of the exterior cuff portion and is located between a medial region of the exterior cuff portion and a lateral region of the exterior cuff portion.

Clause 18. The upper structure of Clause 16, wherein the anterior pull tab is arranged on the exterior cuff portion proximate the intermediate cuff portion.

Clause 19. The upper structure of Clause 12, further comprising a posterior pull tab secured to a posterior region of the exterior cuff portion.

Clause 20. The upper structure of Clause 19, wherein the posterior region of the exterior cuff portion at least partially includes a heel region of the exterior cuff portion and is located between a medial region of the exterior cuff portion and a lateral region of the exterior cuff portion.

Clause 21. The upper structure of Clause 19, wherein the posterior pull tab is arranged on the exterior cuff portion proximate the intermediate cuff portion.

Clause 22. An upper structure of an article of footwear, the upper structure comprising (i) an upper at least partially defining a foot-receiving void and formed at least in part from an inelastic material and (ii) a cuff member formed at least in part from a first elastic material and including a first end coupled to the upper, a second end coupled to the upper, and a fold disposed between the first end and the second end, the fold offset from the upper and at least partially defining an ankle opening in communication with the foot-receiving void.

Clause 23. The upper structure of Clause 22, wherein the cuff member includes an inner surface defining a cuff void extending between the first end, the second end, and the fold.

Clause 24. The upper structure of Clause 23, wherein the cuff void extends between the upper and the fold.

Clause 25. The upper structure of Clause 22, wherein the first end defines a first opening having a first diameter, the second end defines a second opening having a second diameter, and the fold is configured to define a third opening having a third diameter that is greater than the first diameter and the second diameter.

Clause 26. The upper structure of Clause 22, further comprising a strobel coupled to the upper, the strobel and the upper at least partially defining the foot-receiving void.

Clause 27. The upper structure of Clause 22, wherein the first elastic material includes a knit material.

Clause 28. The upper structure of Clause 22, wherein the upper includes an exterior upper member formed from the inelastic material and an interior upper member formed from a second elastic material.

Clause 29. The upper structure of Clause 28, wherein the second elastic material is spandex.

Clause 30. The upper structure of Clause 28, wherein the first end of the cuff member is secured to the exterior upper member by a first fastener and the second end of the cuff member is secured to the interior upper member by a second fastener.

Clause 31. The upper structure of Clause 30, wherein the upper includes an intermediate upper member disposed between the exterior upper member and the interior upper member, the intermediate upper member arranged between the first end of the cuff member and the second end of the cuff member.

Clause 32. The upper structure of Clause 30, wherein the first fastener extends through the exterior upper member and the second fastener extends through the interior upper member.

Clause 33. The upper structure of Clause 32, further comprising a strobel coupled to the upper by a third fastener extending through the strobel and at least the interior upper member, the strobel and the upper at least partially defining the foot-receiving void.

Clause 34. The upper structure of Clause 33, wherein the third fastener extends through the exterior upper member.

Clause 35. The upper structure of Clause 34, wherein the upper further includes an intermediate upper member extending between the exterior upper member and the interior upper member, the third fastener extending through the intermediate upper member.

Clause 36. The upper structure of Clause 22, wherein the cuff member includes an exterior cuff portion, an interior cuff portion, and an intermediate cuff portion connecting the exterior cuff portion to the interior cuff portion, the exterior cuff portion including the first end of the cuff member and the interior cuff portion including the second end of the cuff member.

Clause 37. The upper structure of Clause 36, wherein the interior cuff portion at least partially forms an ankle-receiving void disposed between the ankle opening and the foot-receiving void.

Clause 38. The upper structure of Clause 36, further comprising a heel counter secured to upper and the interior cuff portion, the heel counter at least partially defining the foot-receiving void.

Clause 39. The upper structure of Clause 38, wherein the heel counter at least partially extends over and is secured to the interior cuff portion.

Clause 40. The upper structure of Clause 36, further comprising an anterior pull tab secured to an anterior region of the exterior cuff portion.

Clause 41. The upper structure of Clause 40, wherein the anterior region of the exterior cuff portion includes a tongue region of the exterior cuff portion and is located between a medial region of the exterior cuff portion and a lateral region of the exterior cuff portion.

Clause 42. The upper structure of Clause 40, wherein the anterior pull tab is arranged on the exterior cuff portion proximate the intermediate cuff portion.

Clause 43. The upper structure of Clause 36, further comprising a posterior pull tab secured to a posterior region of the exterior cuff portion.

Clause 44. The upper structure of Clause 43, wherein the posterior region of the exterior cuff portion at least partially includes a heel region of the exterior cuff portion and is located between a medial region of the exterior cuff portion and a lateral region of the exterior cuff portion.

Clause 45. The upper structure of Clause 43, wherein the posterior pull tab is arranged on the exterior cuff portion proximate the intermediate cuff portion.

The foregoing description of the embodiments has been provided for purposes of illustration and description. It is not intended to be exhaustive or to limit the disclosure. Individual elements or feature of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An upper structure of an article of footwear, the upper structure comprising:

an upper including an exterior upper member, an interior upper member, and an intermediate upper member disposed between the exterior upper member and the interior upper member;

a strobel coupled to the upper and cooperating with the upper to at least partially define a foot-receiving void; and a cuff member including a first end coupled to the exterior upper member and a second end coupled to the interior upper member, the cuff member folded over on itself at a fold to at least partially define an ankle-receiving void and including an inner surface defining a cuff void extending between the first end, the second end, and the fold, wherein the intermediate upper member extends from the strobel to the cuff member and is at least partially disposed between the first end of the cuff member and the second end of the cuff member.

2. The upper structure of claim 1, wherein the cuff member is formed from a knit material.

3. The upper structure of claim 1, wherein the interior upper member is formed from an elastic material.

4. The upper structure of claim 3, wherein the elastic material is spandex.

5. The upper structure of claim 3, wherein the exterior upper member is formed from an inelastic material.

6. The upper structure of claim 1, wherein the first end of the cuff member is secured to the exterior upper member by a first fastener and the second end of the cuff member is secured to the interior upper member by a second fastener.

7. The upper structure of claim 6, wherein the strobel is secured to the upper by a third fastener extending through the strobel and at least the interior upper member.

8. The upper structure of claim 7, wherein the third fastener extends through the exterior upper member.

9. An upper structure of an article of footwear, the upper structure comprising:

an upper at least partially defining a foot-receiving void and formed at least in part from an inelastic material; and a cuff member, extending away from the upper, formed at least in part from a first elastic material and including a first end coupled to the upper, a second end coupled to the upper, and a fold disposed between the first end and the second end, the fold being offset from the upper and at least partially defining an ankle opening in communication with the foot-receiving void, the cuff member including an inner surface defining a cuff void extending between the first end, the second end, and the fold, wherein the upper includes an exterior upper member, an interior upper member, and an intermediate upper member disposed between the exterior upper member and the interior upper member, wherein the intermediate upper member extends between the upper and the cuff member, and wherein a first portion of the intermediate upper member is at least partially disposed between opposing portions of the cuff member and a second portion of the intermediate upper member is at least partially disposed between the exterior upper member and the interior upper member.

10. The upper structure of claim 9, wherein the cuff void extends between the upper and the fold.

11. The upper structure of claim 9, wherein the first elastic material includes a knit material.

12. The upper structure of claim 9, wherein the upper includes an exterior upper member formed from the inelastic material and an interior upper member is formed from a second elastic material.

13. The upper structure of claim 12, wherein the second elastic material is spandex.

14. The upper structure of claim 12, wherein the first end of the cuff member is secured to the exterior upper member by a first fastener and the second end of the cuff member is secured to the interior upper member by a second fastener.

15. The upper structure of claim 14, wherein the first fastener extends through the exterior upper member and the second fastener extends through the interior upper member.

16. The upper structure of claim 9, wherein the cuff member includes an exterior cuff portion, an interior cuff portion, and an intermediate cuff portion connecting the exterior cuff portion to the interior cuff portion, the exterior cuff portion including the first end of the cuff member and the interior cuff portion including the second end of the cuff member.

17. The upper structure of claim 16, wherein the interior cuff portion at least partially forms an ankle-receiving void disposed between the ankle opening and the foot-receiving void.

18. The upper structure of claim 16, further comprising a heel counter secured to upper and the interior cuff portion, the heel counter at least partially defining the foot-receiving void.

19. The upper structure of claim 9, further comprising an anterior pull tab secured to an anterior region of the exterior cuff portion.

20. An upper structure of an article of footwear, the upper structure comprising:

an upper including an exterior upper member, an interior upper member, and an intermediate upper member disposed between the exterior upper member and the interior upper member;

a strobel coupled to the upper and cooperating with the upper to at least partially define a foot-receiving void; and a cuff member including a first end coupled to the exterior upper member and a second end coupled to the interior upper member, the cuff member folder over on itself at a fold to at least partially define an ankle-receiving void and including an inner surface defining a cuff void extending between the first end, the second end, and the fold, wherein the first end of the cuff member is secured to the exterior upper member by a first fastener and the second end of the cuff member is secured to the interior upper member by a second fastener, and wherein the intermediate upper member extends from the strobel to the cuff member.

* * * * *